US006739432B2

(12) United States Patent
Elsener

(10) Patent No.: US 6,739,432 B2
(45) Date of Patent: May 25, 2004

(54) INSPECTION OPENING IN AN ELEVATOR CAR

(75) Inventor: Hans Elsener, Lucerne (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 10/172,698

(22) Filed: Jun. 14, 2002

(65) Prior Publication Data

US 2003/0015378 A1 Jan. 23, 2003

Related U.S. Application Data

(63) Continuation of application No. PCT/CH00/00685, filed on Dec. 22, 2000.

(30) Foreign Application Priority Data

Dec. 27, 1999 (EP) ..... 99811216

(51) Int. Cl.[7] ..... B66B 11/02; B66B 13/00
(52) U.S. Cl. ..... 187/401; 187/414; 187/317
(58) Field of Search ..... 187/401, 402, 187/403, 414, 314, 317

(56) References Cited

U.S. PATENT DOCUMENTS 1,986,712 A * 1/1935 Clark ..... 187/401
5,971,109 A * 10/1999 Aulanko et al. ..... 187/263

FOREIGN PATENT DOCUMENTS

| | | | | |
|---|---|---|---|---|
| EP | 0 613 853 A2 | | 9/1994 | |
| EP | 0 680 920 A2 | | 11/1995 | |
| JP | 1231788 A | * | 9/1989 | ..... 187/401 |
| JP | 2-132087 A | * | 5/1990 | ..... 187/414 |
| JP | 2-158579 A | * | 6/1990 | ..... 187/414 |
| JP | 4-159988 A | * | 6/1992 | ..... 187/414 |
| JP | 9-2762 A | * | 1/1997 | |
| JP | 9-202557 A | * | 8/1997 | |
| JP | 1023174 | | 9/1998 | |
| JP | 10-231074 A | * | 9/1998 | |

* cited by examiner

*Primary Examiner*—Eileen D. Lillis
*Assistant Examiner*—Thuy V. Tran
(74) *Attorney, Agent, or Firm*—Schweitzer Cornman Gross & Bondell LLP

(57) ABSTRACT

An elevator car is of a construction which facilitates inspection and maintenance function while enhancing passenger safety. The car includes a closeable inspection and maintenance opening in a sidewall. A transparent inspection window or an inspection grille forms a closure for the opening. The closure may be lockable, and can also include a sensor to monitor its state.

6 Claims, 4 Drawing Sheets

Fig. 3A
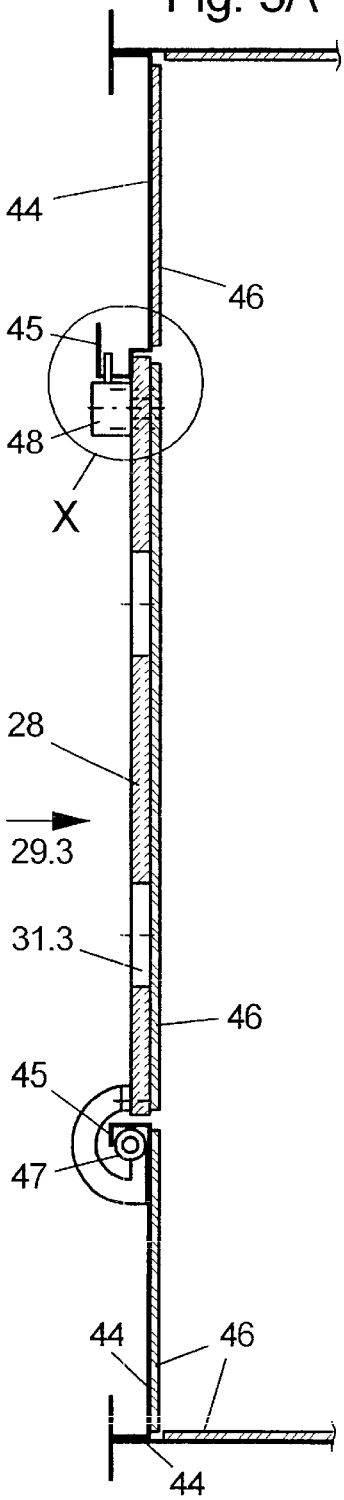
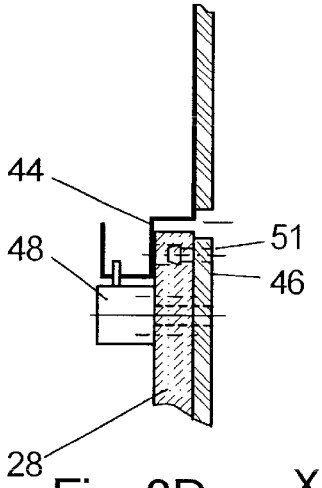
Fig. 3D
(Detail X)
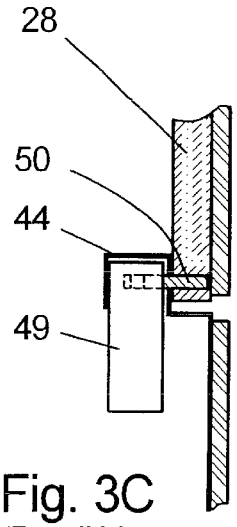
Fig. 3C
(Detail Y)
Fig. 3B
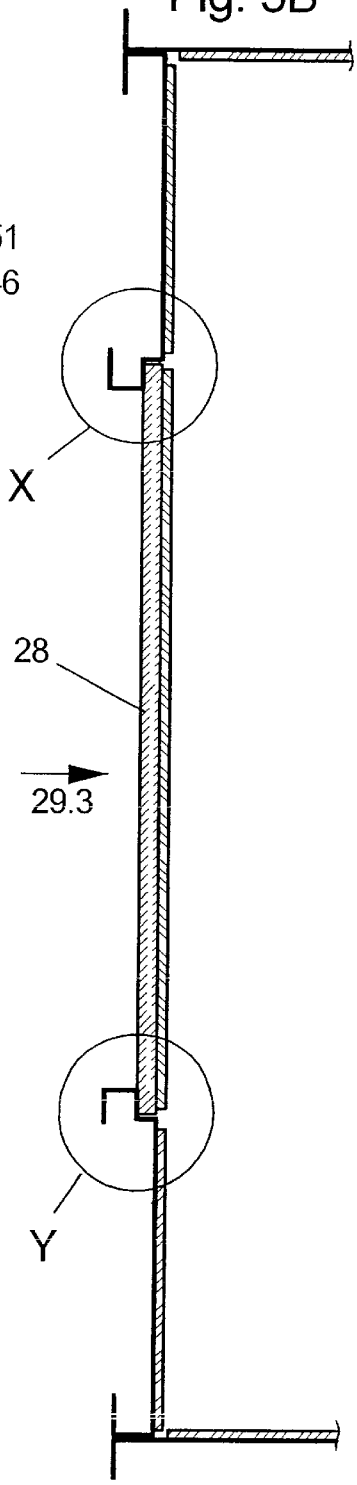

INSPECTION OPENING IN AN ELEVATOR CAR

This application is a continuation of PCT/CH00/00685 filed Dec. 22, 2000.

The present invention relates to a machine-room-less elevator with at least one elevator car which travels in an elevator hoistway having an elevator control which controls at least the travel movements of the elevator, and with various elevator components which are installed in the elevator hoistway and must be periodically inspected, the elevator car having in at least one of its side walls at least one closable inspection and maintenance opening.

BACKGROUND OF THE INVENTION

An elevator of the present type is known from JP 10 231074 A. A machine-room-less elevator is described in which the inspection and maintenance of the elevator components installed in the elevator hoistway or on the elevator car is made possible by there being in the side walls of the elevator car closable inspection and maintenance openings which are situated in the vicinity of the elevator components.

The solution to the problem of inspection and maintenance of machine-room-less elevators described above has the following disadvantages:

During the inspection of elevator components extending or distributed in large number over the entire height of the hoistway, such as guiderails, suspension ropes, overspeed governor rope, guiderail fasteners, and hoistway information emitters, through inspection and maintenance openings which are open during the necessary inspection trip, there is considerable danger to the inspecting person of their head, hands, or arms colliding with or being trapped by objects mounted in the hoistway.

There are no safety devices present which prevent an elevator trip or an inspection trip from taking place with open inspection and maintenance openings or ensure that the inspecting person cannot be present in the vicinity of such an opening during such a trip.

On inspection trips between the positions of individual elevator components to be inspected in the elevator hoistway, with closed inspection and maintenance openings accurately approaching these positions is difficult through lack of visibility into the elevator hoistway.

The objective of the present invention is therefore to propose an elevator concept which while making good use of the hoistway space and without safety space in the hoistway headroom makes inspection and maintenance of all elevator components arranged in the elevator hoistway possible. In doing so, especially the safety of the inspecting person is improved, the checking of elevator components extending or distributed in large number over the entire height of the hoistway is facilitated, and the approach to certain positions on inspection trips is simplified.

BRIEF DESCRIPTION OF THE INVENTION

According to the invention, to fulfill this objective on an elevator of the type stated at the outset it is envisaged that a transparent inspection window or an inspection grille closes the at least one inspection and maintenance opening present in at least one side wall of the car.

The elevator according to the invention allows inspection and maintenance work to be performed on most elevator components arranged in the elevator hoistway from within the car. As well as good utilization of the cross-section of the hoistway space, especially the height of the hoistway headroom can be kept very small, since a safety space for the mechanic above the car is no longer required. The at least one transparent inspection window or inspection grille allows visual checking of the elevator components extending or distributed in large number over the entire height of the hoistway, as for example guiderails, suspension ropes, overspeed governor rope, guiderail fasteners, and hoistway information emitters, during the inspection trip, without a large opening in the car wall being necessary. In this manner maximum safety for the inspecting person is guaranteed. Furthermore, on inspection trips the at least one transparent inspection window or inspection grille simplifies the approach to hoistway positions suitable for the inspection of certain elevator components since it ensures visibility into the elevator hoistway as well as onto the elevator components.

In a preferred embodiment of the invention, the closed transparent inspection window or the inspection grille has at least one key-turned lock which must be unlocked by means of a key element before opening the inspection window or inspection grille. In this manner, opening of the transparent inspection window or of the inspection grille by unauthorized persons, and situations which are dangerous for passengers, are prevented.

In a manner expedient for safety, the closed state of the at least one transparent inspection window or of the inspection grille is monitored by an electric sensor and the corresponding signal conducted to the elevator control. Depending on the control program present, with unclosed inspection window or inspection grille, safety-relevant functions of the elevator such as, for example, normal trips, level-correction trips, or inspection trips, are disabled.

In a further preferred embodiment of the invention, the transparent inspection window consists in essence of a pane of laminated glass or a pane of suitable transparent plastic such as acrylic glass or plexiglass. A window frame is not required, and the necessary fastening, hinge, and locking components can be mounted directly onto the transparent window panes, preferably by bonding with adhesive or by a combination of bonding and bolting. This flat method of construction allows the inspection window to be built into the car wall without the window projecting either inwardly or outwardly beyond the car wall, and for it to be swiveled without problem on hinges out of a narrow space within the car wall into the interior of the car.

In a further embodiment of the invention, in normal operation the transparent inspection window or inspection grille is covered by a removable decoration or cladding element or by a mirror plate. In this manner the visual appearance of the car interior is unimpaired by the inspection window or the inspection grille, and the passengers' feeling of safety is not negatively affected by the view into the elevator hoistway. Such plate-shaped elements are preferably fastened to the transparent inspection window or inspection grille by means of screws, or push-in pins with elastic diameter, or a combination of both.

Special advantages are achieved by transparent inspection windows or inspection grilles, which have one or more reach-through openings. Placed in suitable manner, these allow hands and arms to reach through the closed inspection window or inspection grille and to perform certain manipulations on elevator components, or to sense their state by touch. Although the reach-through openings are limited by their dimensions to the passage of hands and arms, many inspection and maintenance operations can be performed in great safety for the inspecting person without opening the entire inspection window or inspection grille. In this manner much inspection time can be saved.

An advantageous further development of the invention is that at least one sensor, for example a light barrier or a light curtain, monitors the at least one reach-through opening of an inspection window or inspection grille for projecting objects. The preferably electrical output signal of the sensor on detection of projecting objects causes the elevator control to prevent all travel movement of the elevator car.

According to a further embodiment of the elevator according to the invention, the wall of the elevator hoistway above the hoistway doors assigned to the uppermost stop of the elevator car has an opening which provides the inspecting person with vision onto the car door drive, the coupling device between car door and hoistway door, and the hoistway door lock, and also permits manual access to the aforementioned elements. This opening is necessary because inspection and maintenance of these elements in the uppermost area of the hoistway cannot be performed from the car roof as usual, due to the absence of safety space, and also not through openings in a car wall. The opening can be closed with an inspection door.

According to a further preferred embodiment of the invention, in the vicinity of the bottom end-position of the counterweight in the elevator hoistway, an arrester with a normal setting and with an arresting setting is installed. When positioned in the arresting setting, this gives support to the downward-traveling counterweight before it reaches its lower end-position, so that the counterweight-side suspension ropes are relieved. As a result of this relief, the transmissible traction force between the traction sheave and the suspension ropes is reduced to such an extent that the elevator car comes to a standstill before reaching its upper end-position. The arrester, positioned by the inspecting person according to need in the arresting setting, arrests the counterweight so far in advance of its lower end-position that in the space between the hoistway headroom and the car roof a sufficiently high safety space for a person is created. Such a safety space, which with the present machine-roomless elevator arrangement is not present in normal operation, is absolutely essential if an inspection or maintenance person must perform inspection trips on the car roof. This is especially advantageous for checking and maintaining the above-mentioned components in the vicinity of the door drive, since an opening in the hoistway wall as described above should as far as possible remain restricted to the uppermost floor for aesthetic reasons.

In yet a further embodiment of the elevator according to the invention, there is in the elevator car a command device for controlling inspection trips at reduced speed. It is advantageous for this to be equipped with an extension cable so that the inspection trips can be controlled from any position in the elevator car, so that visual inspection of elevator components through transparent inspection windows or inspection grilles during the inspection trip is possible. In normal operation the control device is preferably accommodated in a lockable compartment of the car control panel.

According to a further advantageous embodiment variant, the elevator control is so programmed that with unclosed inspection window or inspection grille, or when an object is projecting out of a reach-through opening, either no travel of the elevator car, or only an inspection trip at reduced speed, is possible. Such an inspection trip can only be commanded if on the command device for controlling inspection trips two buttons which cannot be reached simultaneously with the fingers of one single hand are actuated simultaneously for each trip. Such actuation therefore requires both hands, which ensures that no travel of the elevator can take place as long as one hand of the inspecting person is still outside the elevator car.

BRIEF DESCRIPTION OF THE DRAWINGS

The invention is explained in greater detail below by reference to exemplary embodiments which are illustrated diagrammatically by the annexed drawings. For components which are identical or functionally identical, the same reference numbers are used throughout.

FIG. 3A is a cross-section through an elevator car wall having an inspection and maintenance opening covered by a transparent inspection window or inspection grill fastened in a swiveling manner;

FIG. 3B is a cross-section through an elevator car wall having an inspection and maintenance opening covered by a transparent inspection window or inspection grill fixed by means of key-operated locks;

FIG. 3C is a detail drawing showing the arrangement of a safety switch at a location Y;

FIG. 3D is a detail drawing showing the fastening of the transparent inspection window or inspection grille with cladding or decorative elements at a location X.

DETAILED DESCRIPTION OF THE INVENTION

Figure 1:
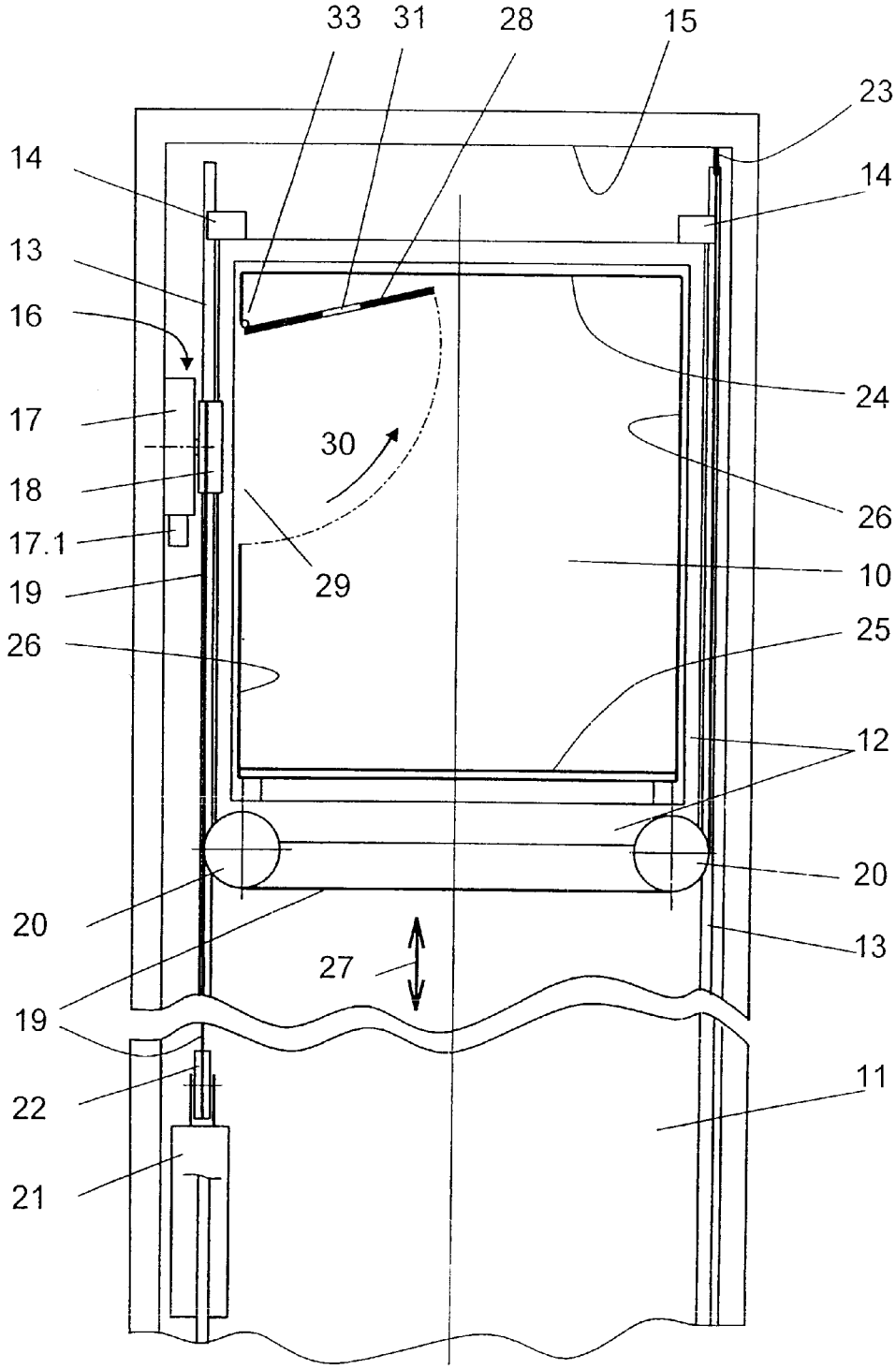
FIG. 1 is a diagrammatical longitudinal cross-section through the hoistway headroom of an elevator hoistway having placed in it an elevator car according to the invention with an underslung suspension rope arrangement.

FIG. 1 shows a diagrammatical longitudinal cross-section through a first elevator construction with an underslung suspension rope arrangement, in which an elevator car 10 can be caused to travel in an elevator hoistway 11 in the direction shown by the arrow 27. The car 10 has a car frame 12 and is guided on guiderails 13 by diagrammatically shown guide shoes 14 fastened to the car frame 12, and can be caused to travel close up to a hoistway ceiling 15 of the hoistway space 11. The purpose of moving the car 10 is served by a drive unit 16, which has a drive motor 17 with brake and also a traction sheave 18. The traction sheave 18 acts in conjunction with a suspension rope 19, which is passed downward from one side of the traction sheave 18, under the pulleys 20, beneath and across the car 10, upward on the other side of the hoistway to a first rope anchor point 23, and from the other side of the traction sheave 18 downward around a counterweight suspension pulley 22, and upward again to a second rope anchor point (not shown here) in the headroom area of the hoistway.

The car 10 has a roof 24, a car floor 25, and four side walls 26. In FIG. 1, the side wall 26 facing the drive unit 16 has an inspection and maintenance opening 29 which can be closed with a transparent inspection window or inspection grille 28 according to the invention. The inspection window or inspection grille can be swiveled about a horizontal axis 33 in the direction of the arrow 30, and in swiveled-out position can be locked against the car roof 24. Through the closed transparent inspection window or inspection grille, the inspecting person can perform visual checks on elevator components such as, for example, the drive unit 16 comprising drive motor 17 with brake 17.1 and traction sheave 18, the suspension ropes 19, the counterweight 21, as well as on the overspeed governor not shown here and the associated overspeed governor rope, without being endangered by elevator components installed in the elevator hoistway and moving past relative to the elevator car.

Should manual access to elevator components mounted in the elevator hoistway be necessary for inspection or maintenance work, the inspecting person can perform this either through reach-through openings in the transparent inspection window or inspection grille, or unlock and open the transparent inspection window or inspection grille with a key element.

The dimensions of the at least one inspection and maintenance opening, and therefore the associated transparent inspection window or inspection grille 28, are adapted to the objects in their vicinity which are to be inspected or maintained. This also applies to dimensions and positions of the reach-through openings 31 fitted in the transparent inspection windows or inspection grilles.

Figure 2A:
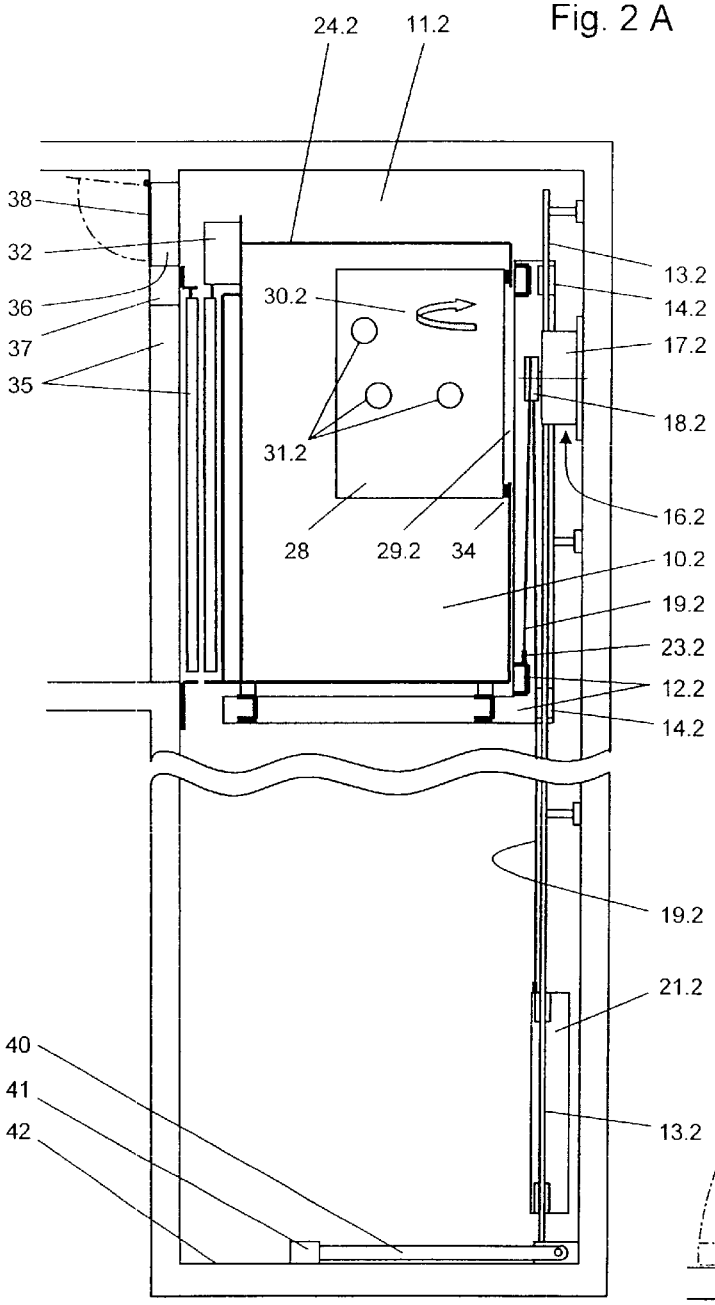
FIG. 2A is a diagrammatical longitudinal cross-section through an elevator hoistway having placed in it an elevator car in accordance with the invention arranged in a rucksack manner.

FIG. 2A shows a diagrammatical longitudinal cross-section through a second elevator variant with an elevator car 10.2 arranged in a so-called rucksack manner. Elevator components which correspond to those in FIG. 1 are assigned the same reference numbers. These elevator components are explained in the foregoing relating to FIG. 1. In the exemplary embodiment according to FIG. 2A, both guiderails 13.2 are fastened to a single hoistway wall. The elevator car 10.2 stands on an L-shaped car frame 12.2 which is guided by means of guide shoes 14.2 on the guiderails 13.2 on a vertical path in the hoistway space 11.2. In the upper hoistway area between the elevator car 10.2 and the hoistway wall with the guiderails, in the area between the said guiderails, a drive unit 16.2 is fitted which has a drive motor 17.2 with brake and a traction sheave 18.2. The traction sheave 18.2 acts on a suspension rope 19.2 which extends downward from one side of the traction sheave 18.2 to a rope anchor point 23.2 fastened on the car frame 12.2, and from the other side of the traction sheave 18.2 to a rope anchor point on a counterweight 21.2.

In both elevator variants (FIG. 1 and FIG. 2A) the elevator car 10 can be caused to travel past the drive unit 16. Consequently, the elevator car 10 can travel very close to the hoistway ceiling 15 of the elevator hoistway 11, so that the necessary height of the hoistway space 11 is restricted to a minimum.

In the exemplary embodiment according to FIG. 2A, shown in the elevator car 10.2 is an opened transparent inspection window or inspection grille which, as indicated with arrow 30.2, can be swiveled around a vertical axis 34 and in normal operation covers an inspection and maintenance opening 29.2. From FIG. 2A it can also be seen that after opening the transparent inspection window or inspection grille, the complete drive unit 16.2, the suspension ropes 19.2, the guiderails 13.2, the guide shoes 14.2, the counterweight 21.2, as well as an overspeed governor not shown here with the associated overspeed governor rope, are accessible through the inspection and maintenance opening 29.2. The same elements can be inspected visually while the elevator car 10.2 is stationary as well as during an inspection trip with closed inspection window or inspection grille. Here too, manual access to these elements for inspection and maintenance purposes with closed inspection window or inspection grille is possible through reach-through openings 31.2.

In FIG. 2A, above the upper hoistway door 35 of the elevator hoistway 11 there is an opening 36 through the front-side hoistway wall 37 which in normal operation is closed by an inspection door 38 and locked by means of a key-turned lock. The purpose of this opening 36 is especially to permit inspection and maintenance of the drive connection between the car door drive 32 and hoistway door 35 as well as the hoistway door locking device with its monitoring switch, since with the present machine-room-less elevator arrangement with no safety space these activities cannot be performed in the otherwise usual manner from the roof of the elevator car.

Figure 2B:
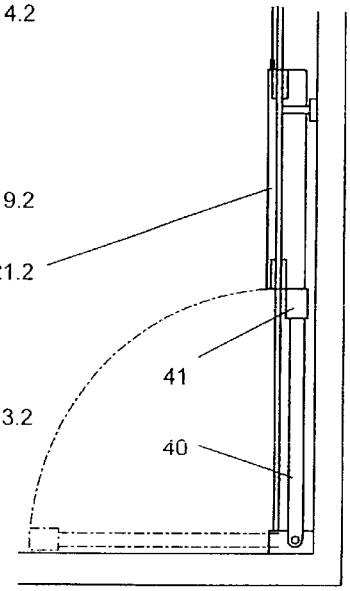
FIG. 2B is an extract from FIG. 2A showing a support swiveled into active position under the counterweight of the elevator.

Visible at the bottom edge of FIG. 2A is a pivotable support 40 with a buffer 41 mounted on its upper end which in normal operation lies in a horizontal position on the floor of the hoistway pit 42. In its vertical position, the pivotable support 40 serves to block the counterweight 21.2 before this has reached its lower end-position as shown in FIG. 2B. As result, the elevator car 10.2 is also brought to rest before its upper end-position, since without the effect of the counterweight the remaining transfer of force between the counterweight and suspension ropes is insufficient to raise the elevator car 10.2 further. With this arrangement, a safe safety space for the inspecting person is created above the car roof 24.2. This safety space is especially necessary for the inspection and maintenance of the aforementioned drive connection between car door drive and hoistway doors as well as their hoistway door locking devices with their monitoring switches on those floors on which the previously described opening 36 in the hoistway wall 37 above the hoistway doors 35 is not present.

FIGS. 3A to 3D show diagrammatically embodiment details of inspection and maintenance openings 29.3 according to the invention with transparent inspection windows or inspection grille 28 in a side wall of an elevator.

Visible in FIG. 3A are wall elements 44 of an elevator car which is usually manufactured from steel sheet and has on its long sides folded edges 45 as stiffeners. On the surfaces of the wall elements 44, cladding or decor elements 46 are fastened, their fastening usually being affected by means of adhesive bonding or screws. In the car wall illustrated, between two wall elements 44 there is an inspection and maintenance opening 29.3 according to the invention. This inspection and maintenance opening 29.3 is covered by a transparent inspection window or inspection grille which on one side is fastened in a swiveling manner by at least one hinge 47 to one of the wall elements 44. The side of the transparent inspection window or inspection grille lying opposite the hinge is locked to the folded edge of the second wall element 44 by at least one key-turned lock 48. Also visible are two reach-through openings 31.3. On the surfaces of the transparent inspection window or inspection grille, cladding or decor elements 46 are also fastened, here by means of snap-in expanding pins 51 as shown in FIG. 3D, so that these cladding and decor elements can be easily removed for visual inspection.

FIG. 3B shows an inspection and maintenance opening 29.3 which is closed by a transparent inspection window or inspection grille fixed by means of key-turned locks (as shown in FIG. 3D). Such transparent inspection windows or inspection grilles are to be unlocked and removed according to need. For the purpose already described, they can also have reach-through openings.

FIG. 3C shows how a safety switch 49 built into the folded edge of a wall element 44 monitors the closed state of a transparent inspection window or inspection grille 28. Such a safety switch 49 can only be actuated with a special switching piece 50. At least one such switching piece 50 is anchored in the transparent inspection window or inspection grille and in the closed state of the latter actuates the safety switch 49.

FIG. 3D shows details of the fastening of the transparent inspection window or inspection grille 28 as well as the cladding and decor elements 46. The transparent inspection windows or inspection grilles are fastened and secured to the folded edges 45 of the wall elements 44 by at least two key-turned locks.

The cladding and decor elements 46 are so fastened with expanding pins 51 in the stepped holes of the transparent inspection window or inspection grille that they can be released and removed with simple tools.

Figure 4:
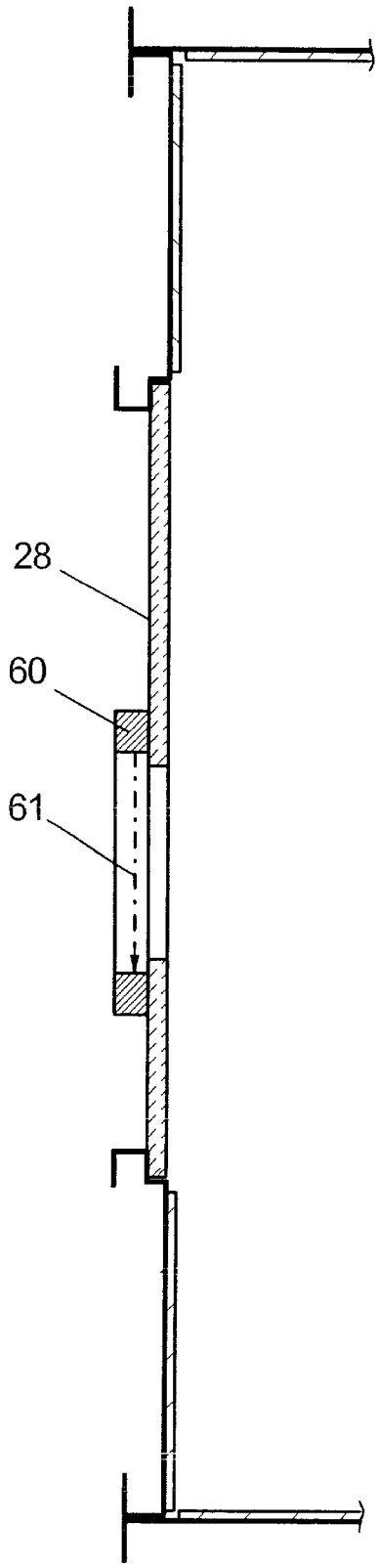
FIG. 4 is a horizontal cross-section showing a light curtain to monitor a reach-though opening.

FIG. 4 depicts an inspection window or inspection grille 28 fitted with means 60 to monitor whether an object is projecting from the inspection window or inspection grille. As shown, the means is a light curtain generator of conventional construction, generating a light curtain 61. The monitor means can control safety-relevant elevator functions as known and appropriate.

I claim:

1. An elevator car of the type for use in a machine-room less elevator installation in which the elevator car which moves in an elevator hoistway with an elevator control which controls at least the travel movements of the elevator car and elevator components which are installed in the elevator hoistway for periodic inspection, the elevator car comprising a closable inspection and maintenance opening in a side wall and a transparent inspection window consisting essentially of laminated glass or transparent plastic forming a closure for the inspection and maintenance opening with a removable cladding or décor element covering for the closure, and a sensor to monitor the state of the closure for control of safety-relevant functions of the elevator control.

2. The elevator car according to claim 1 further comprising a key element-operable safety lock for the closure.

3. An elevator car of the type for use in a machine-room less elevator installation in which the elevator car which moves in an elevator hoistway with an elevator control which controls at least the travel movements of the elevator car and elevator components which are installed in the elevator hoistway for periodic inspection, the elevator car comprising a closable inspection and maintenance opening in a side wall and a transparent inspection window consisting essentially of laminated glass or transparent plastic forming a closure for the inspection and maintenance opening, the closure further including at least one reach-through opening to allow access to elevator components, and a sensor to monitor the state of the closure for control of safety-relevant functions of the elevator control.

4. The elevator car according to claim 3 further comprising a key element-operable safety lock for the closure.

5. The elevator car according to claim 3 or 4 further comprising a removable cladding or décor element covering for the closure.

6. The elevator car according to claim 3 further comprising means to monitor whether an object is projecting from the reach-through opening for control of safety-relevant functions of the elevator control.

* * * * *